US007678030B2

(12) United States Patent
Savage

(10) Patent No.: US 7,678,030 B2
(45) Date of Patent: Mar. 16, 2010

(54) DUMBBELL RETAIL/STORAGE RACK

(75) Inventor: Michael J. Savage, Millbury, MA (US)

(73) Assignee: Fitness Equipment Manufacturing, LLC, Sutton, MA (US)

( * ) Notice: Subject to any disclaimer, the term of this patent is extended or adjusted under 35 U.S.C. 154(b) by 526 days.

(21) Appl. No.: 11/362,994

(22) Filed: Feb. 27, 2006

(65) Prior Publication Data

US 2006/0205573 A1 Sep. 14, 2006

Related U.S. Application Data

(60) Provisional application No. 60/657,625, filed on Mar. 1, 2005.

(51) Int. Cl.
*A63B 21/078* (2006.01)

(52) U.S. Cl. ..... 482/104

(58) Field of Classification Search ..... D21/694; D6/552; 482/94, 104, 106–108, 142
See application file for complete search history.

(56) References Cited

U.S. PATENT DOCUMENTS 4,666,150 A * 5/1987 Segrist et al. ..... 482/104
4,848,855 A * 7/1989 Cone ..... 312/107
D329,563 S * 9/1992 Rasmussen ..... D6/552
5,924,964 A * 7/1999 Hayden ..... 482/104
5,971,898 A * 10/1999 Schoolfield ..... 482/104
6,123,651 A * 9/2000 Ellenburg ..... 482/104
D453,542 S * 2/2002 Louiso ..... D21/694
D455,310 S * 4/2002 Webber ..... D6/552
D487,490 S * 3/2004 Evans ..... D21/686
D495,382 S * 8/2004 Ceppo ..... D21/686
D495,383 S * 8/2004 Ceppo ..... D21/686
D506,516 S * 6/2005 Yang ..... D21/694
7,022,053 B2 * 4/2006 Whetstone ..... 482/104
D528,173 S * 9/2006 Flick et al. ..... D21/686
D578,173 S * 10/2008 James ..... D21/690
2005/0009671 A1 * 1/2005 Hummer, Jr. ..... 482/94

* cited by examiner

*Primary Examiner*—Fenn C Mathew
(74) *Attorney, Agent, or Firm*—Brian M. Dingman; Mirick, O'Connell, DeMallie & Lougee, LLP

(57) ABSTRACT

A dumbbell retail/storage rack that has a first section with a bottom side that is designed to sit on a flat surface, and a top side that defines one or more dumbbell-receiving structures. Each of these structures has two spaced saddles for receiving the enlarged ends of a dumbbell. The retail/storage rack also has a second section that is integrally coupled to the first section and has a bottom that is essentially perpendicular to the bottom of the first section. This arrangement creates an "L"-shaped rack that can be placed on the bottom of either the first section or the second section, to display or to hold two or more dumbbells, as desired.

8 Claims, 9 Drawing Sheets

DUMBBELL RETAIL/STORAGE RACK

CROSS REFERENCE TO RELATED APPLICATION

This application claims priority of Provisional application Ser. No. 60/657,625, filed on Mar. 1, 2005.

FIELD OF THE INVENTION

This invention relates to a structure for holding two or more dumbbells at retail and at the consumer level.

BACKGROUND OF THE INVENTION

Small dumbbells, typically no more than ten pounds each, are commonly used. Such dumbbells are typically stored in large vertical linear racks in which the dumbbells are held one on top of another. This may be appropriate for gyms and certain retail locations, but is an unwieldy, unnecessary solution for the homeowner who only needs to store two, or perhaps four, dumbbells. Also, such racks are located on the floor and are thus not appropriate for retail display on store racks, or homeowner storage on racks or shelves, for example.

SUMMARY OF THE INVENTION

It is therefore an object of this invention to provide a rack that can be used to display a small number of dumbbells at retail, but is also useful as a homeowner dumbbell storage rack. The inventive retail/storage rack is useful for both displaying at retail and storing by the user of a plurality of dumbbells (typically two, or possibly three or four) of the type that have two enlarged ends joined by a more narrow middle portion. Such dumbbells usually come in standards weights of 1, 2, 3, 5, 8, 10, etc. pounds each.

The dumbbell retail/storage rack may have a first section with a bottom side that is designed to sit on a flat surface, and a top side that defines one or more dumbbell-receiving structures. Each of these structures has two spaced saddles for receiving the enlarged ends of a dumbbell. The retail/storage rack also has a second section that is integrally coupled to the first section and has a bottom that is essentially perpendicular to the bottom of the first section. This arrangement creates an "L"-shaped rack that can be placed on the bottom of either the first section or the second section, to display or to hold two or more dumbbells, as desired.

The dumbbell retail/storage rack may have two essentially identical dumbbell-receiving structures. One of the dumbbell-receiving structures may be located in part in the first section and in part in the second section. The two structures may lie side-by-side. The two structures may be essentially parallel to one another. The two structures may lie generally in a plane that is essentially parallel to the plane of the bottom side of one of the sections.

The dumbbell retail/storage rack may further comprise an opening between the saddles of at least one structure. The opening may be in one section. The opening may be between at least parts of the saddles of both structures.

The two sections may be transverse to one another. The bottoms of the two sections may be essentially perpendicular to one another. The rack may be essentially "L" shaped. The rack may further comprise a series of small openings that are adapted to accept dumbbell-retaining bands. The openings may be proximate to the saddles. The openings may be in sets of two, with the two openings of each set on opposite sides of the longitudinal centerline of a dumbbell. There may be two sets of openings for each section, so that each dumbbell is held by two dumbbell-retaining bands.

At least one saddle may comprise a pair of upwardly-diverging walls. The upwardly-diverging walls may be sloped away from the dumbbell. The upwardly-diverging walls may be curved. At least one saddle may further comprise an inner wall between the pair of upwardly-diverging walls. The inner wall may span the longitudinal axis of a dumbbell received in the saddle.

Featured in another embodiment is an integral dumbbell retail/storage rack for displaying at retail and storing one or more dumbbells, each dumbbell having two enlarged ends and a more narrow middle portion, comprising a first section having a bottom side that is adapted to sit on a flat surface and a top side that defines two essentially identical dumbbell-receiving structures that lie side-by-side and are essentially parallel to one another, each such structure having two spaced saddles for receiving the enlarged ends of a dumbbell, and a second section integrally coupled to the first section and having a bottom that is essentially perpendicular to the bottom of the first section.

BRIEF DESCRIPTION OF THE DRAWINGS

Other objects, features and advantages will occur to those skilled in the art from the following description of the preferred embodiments and the accompanying drawings, in which one preferred embodiment of the invention, which is an integral molded plastic item, is shown in FIGS. 1-7.

DETAILED DESCRIPTION OF THE PREFERRED EMBODIMENTS OF THE INVENTION

Figure 1:
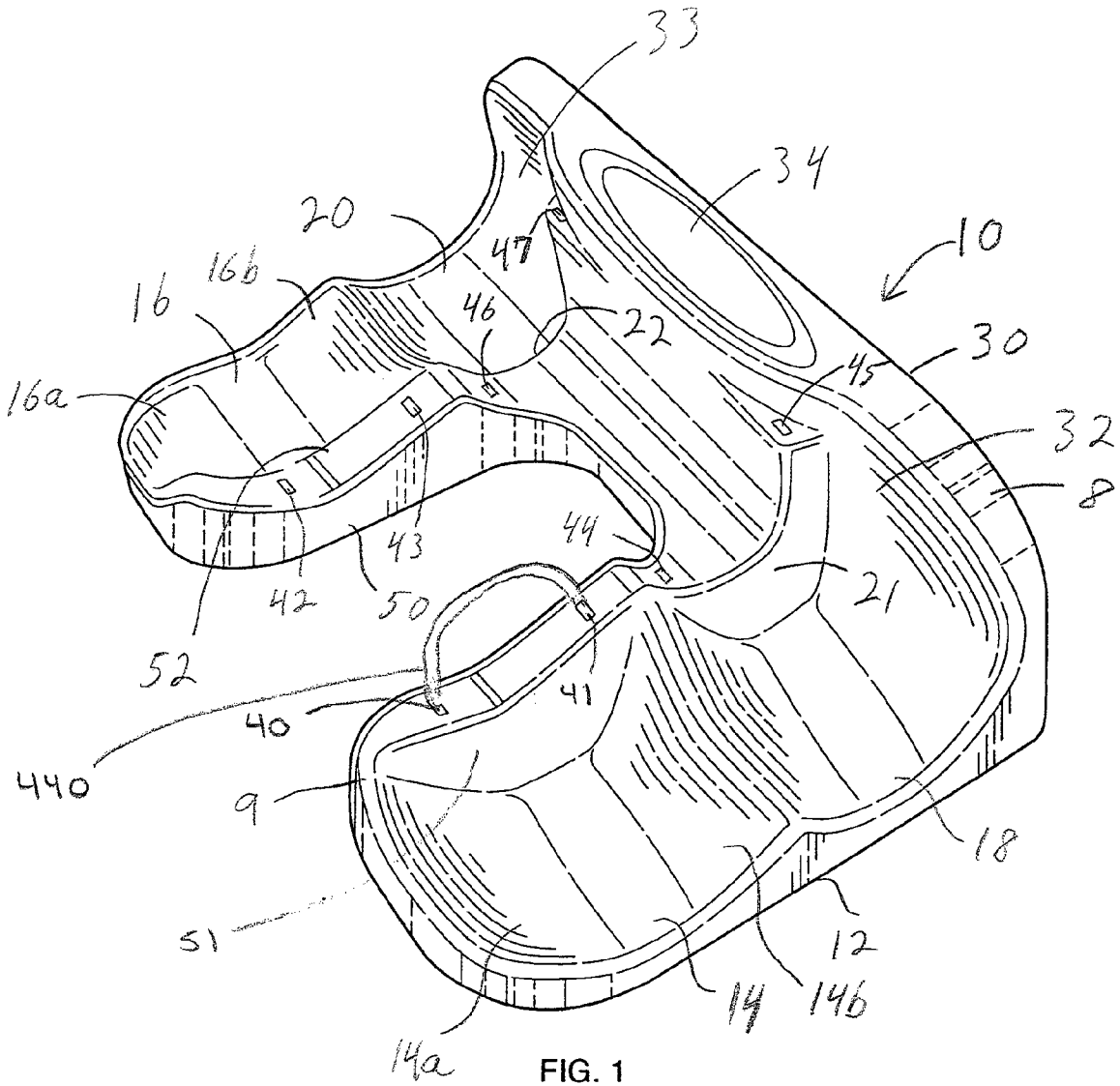
FIG. 1 is a perspective view of one preferred embodiment of the dumbbell retail/storage rack of the invention.
Figure 2:
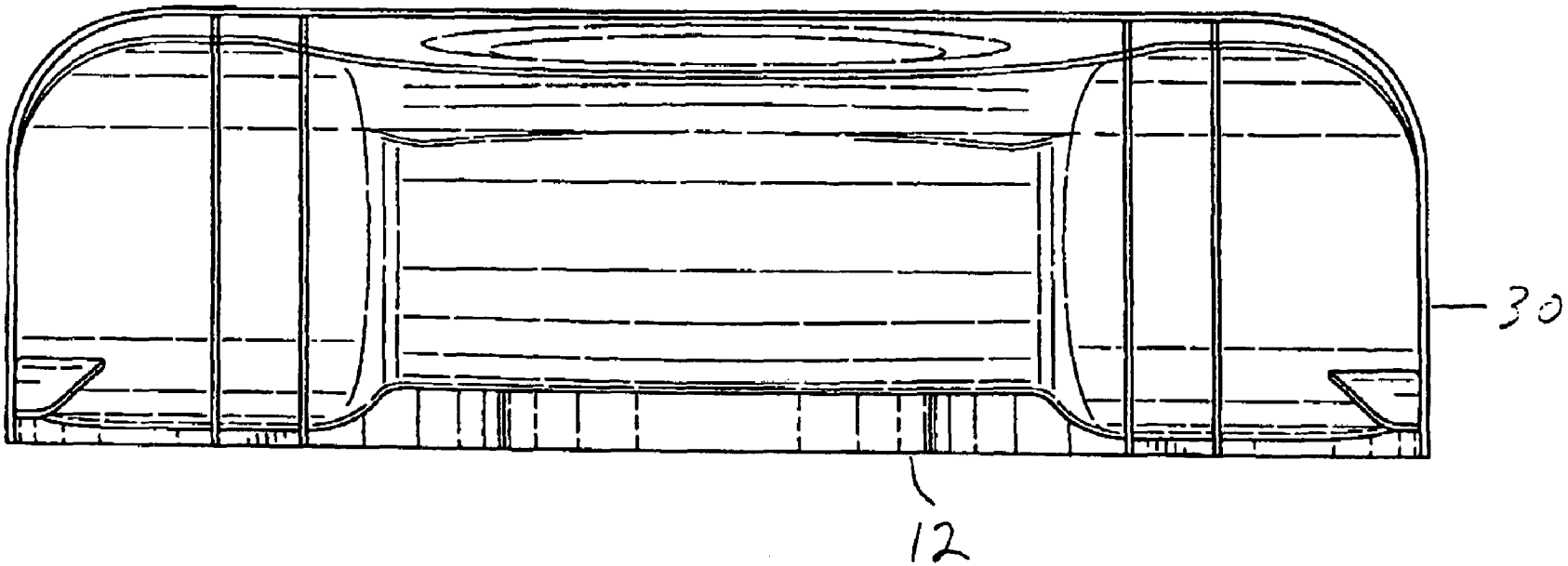
FIG. 2 is a back view of a dumbbell retail/storage rack of FIG. 1.

FIGS. 1-7 show dumbbell retail/storage rack 10 according to this invention. Dumbbell retail/storage rack 10 includes first section 9 having an elongated bottom side 12 that is adapted to sit on a flat surface such as a shelf, table or floor. The opposite top side of section 9 defines one or more dumbbell-receiving structures. Each such structure has two spaced saddles for receiving the enlarged ends of a dumbbell. In this embodiment, there are two such structures, one having spaced saddles 14 and 16 and the second having spaced saddles 18 and 20.

Second section 8 of rack 10 is integrally coupled to first section 9 and has shorter bottom 30 that is essentially perpendicular to bottom 12 of first section 9. This creates an "L" shape, which allows dumbbell retail/storage rack 10 to be stood up on either bottom 12 or bottom 30. In order to save retail shelf space, the rack is typically placed on bottom 30.

When used by the homeowner to store the dumbbells, the rack is typically placed on longer bottom 12, with the two dumbbells nestled into the two dumbbell-receiving structures.

Each of the saddles is defined by opposing sloped sidewalls such as sidewalls 14*a* and 14*b* of saddle 14, and sidewalls 16*a* and 16*b* of saddle 16, and is further defined by upwardly-directed interior walls 51 and 52. These walls together serve to form spaced wells or saddles that support the enlarged rounded ends of the dumbbells. The saddles prevent a dumbbell from moving in either direction; either substantially longitudinally along the direction of its more narrow middle portion, or in a direction parallel to the longitudinal axis.

Figure 3:
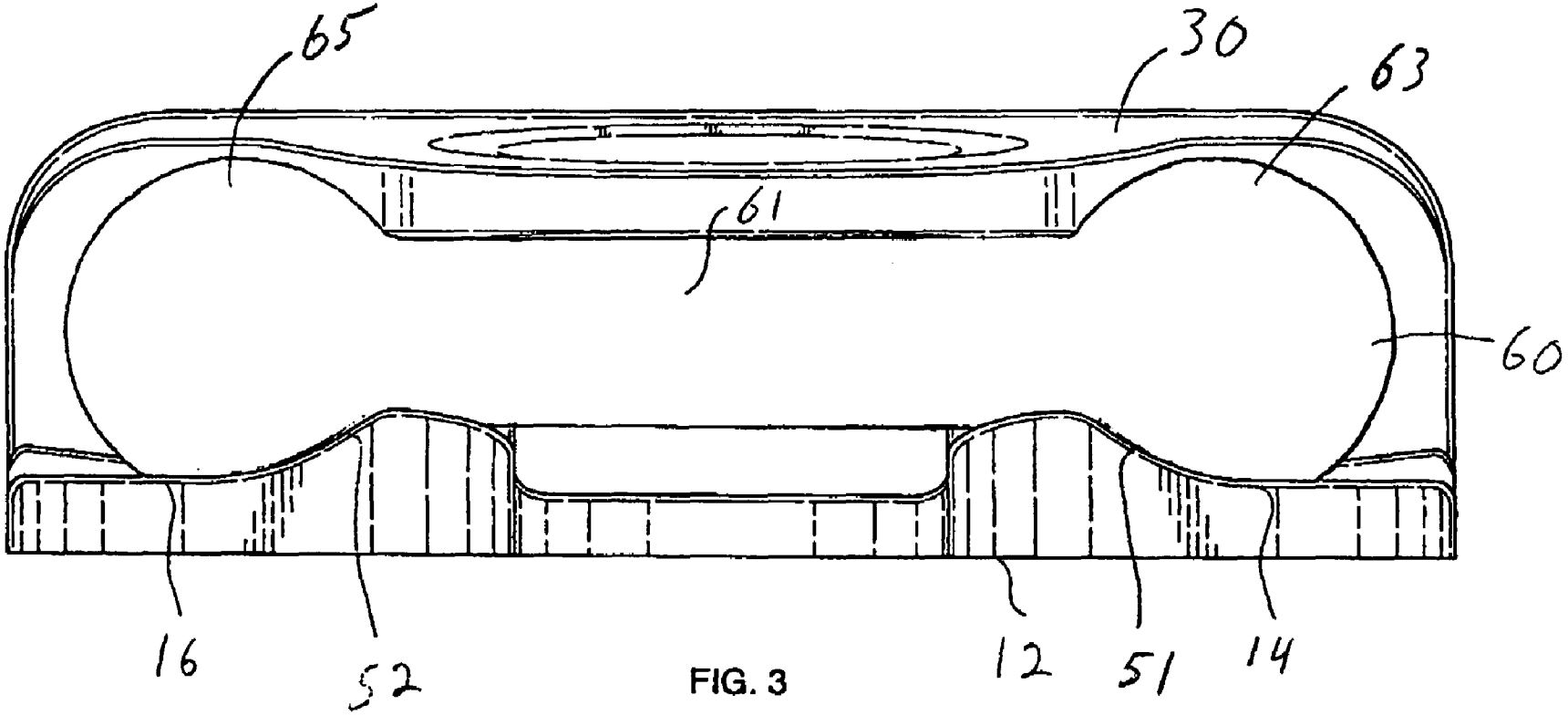
FIG. 3 is a front view of the dumbbell retail/storage rack of FIG. 1.
Figure 4:
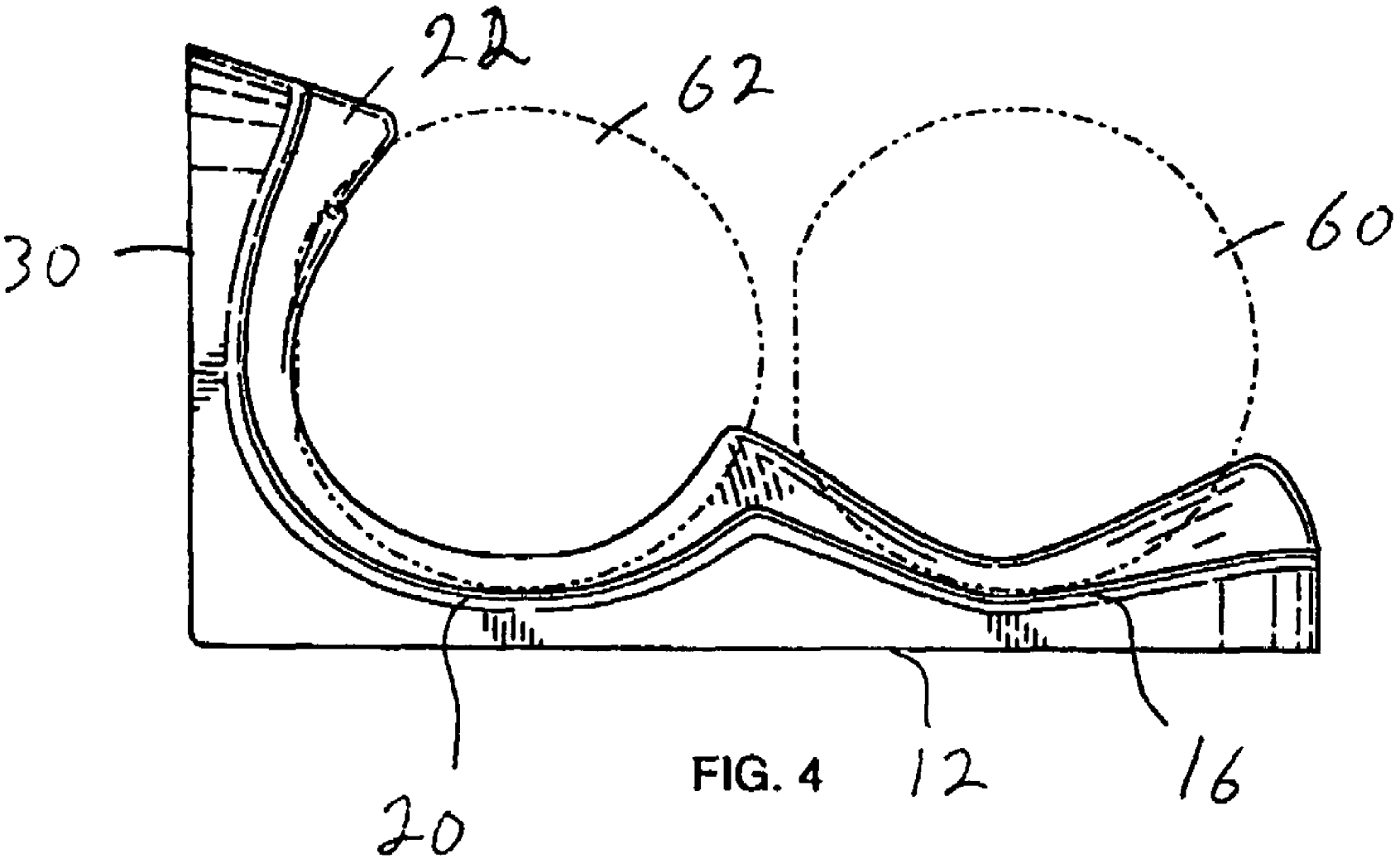
FIG. 4 is a left side view and FIG. 5 a right side view of the dumbbell retail/storage rack of FIG. 1.
Figure 5:
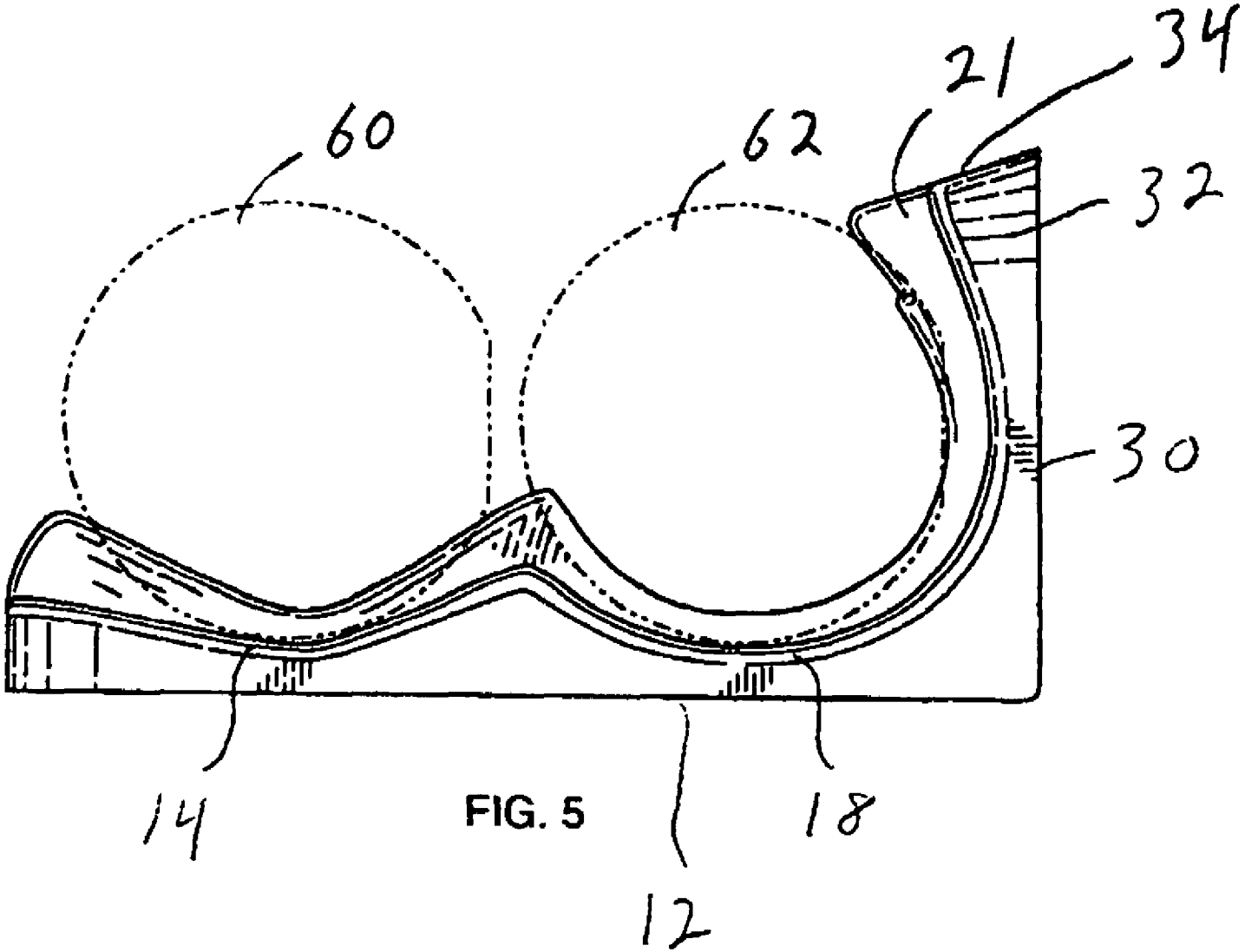

The effect of walls 51 and 52 are shown in FIG. 3. The saddles are preferably structured such that as a whole they nestle enlarged ends 63 and 65 of dumbbell 60 (as one example). Saddles 18 and 20 are constructed in a similar manner to saddles 14 and 16 and include interior upwardly-directed walls 21 and 22. The pair of upwardly-diverging walls of each saddle may be sloped away from the dumbbell. The upwardly-diverging walls may be curved as shown in the drawings so that they nestle a rounded end of a dumbbell. At least one saddle may further comprise an inner wall between the pair of upwardly-diverging walls. The inner wall may span the longitudinal axis of a dumbbell received in the saddle, as shown in the drawings.

Figure 6:
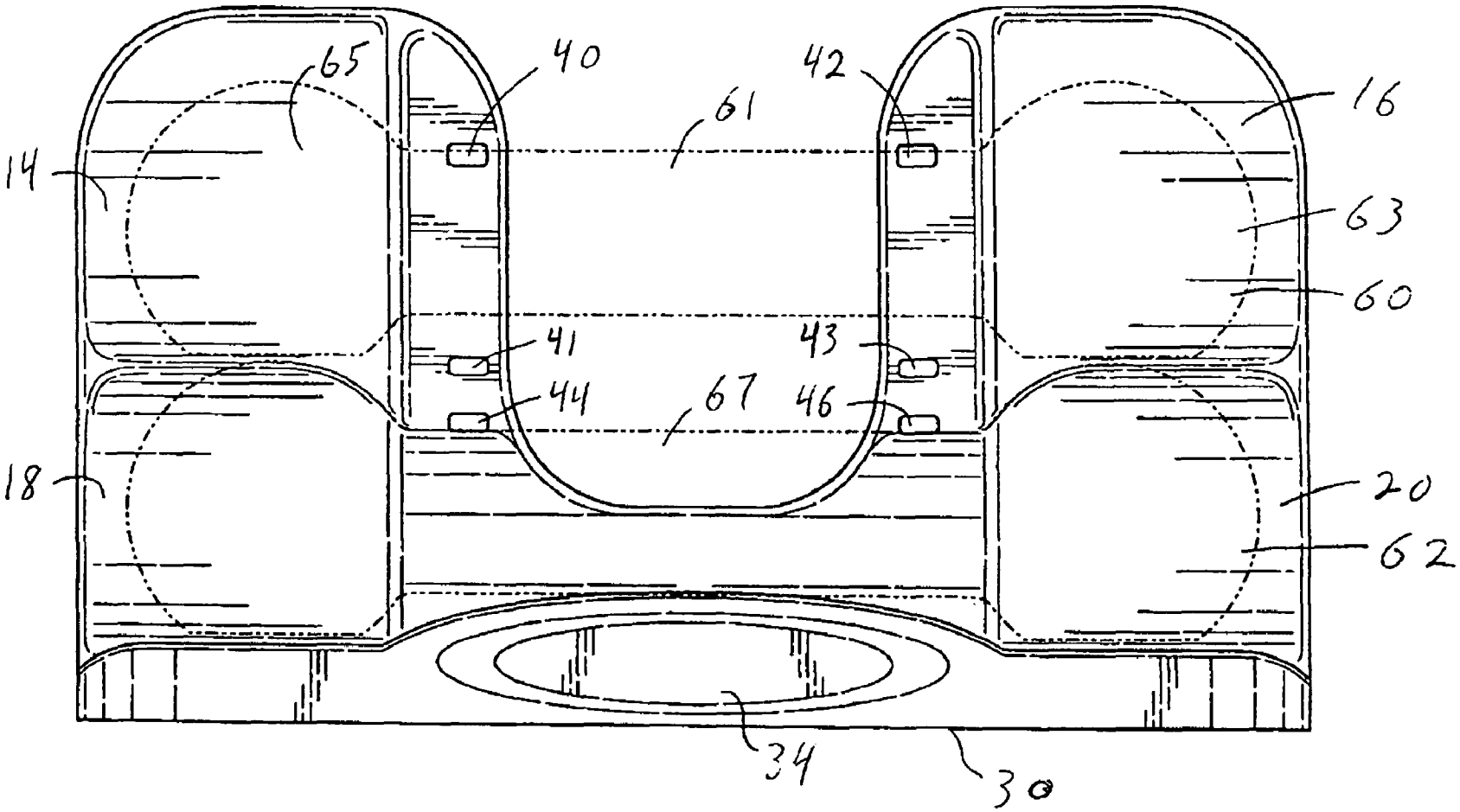
FIG. 6 is a top view and FIG. 7 a bottom view of the dumbbell retail/storage rack of FIG. 1.
Figure 7:
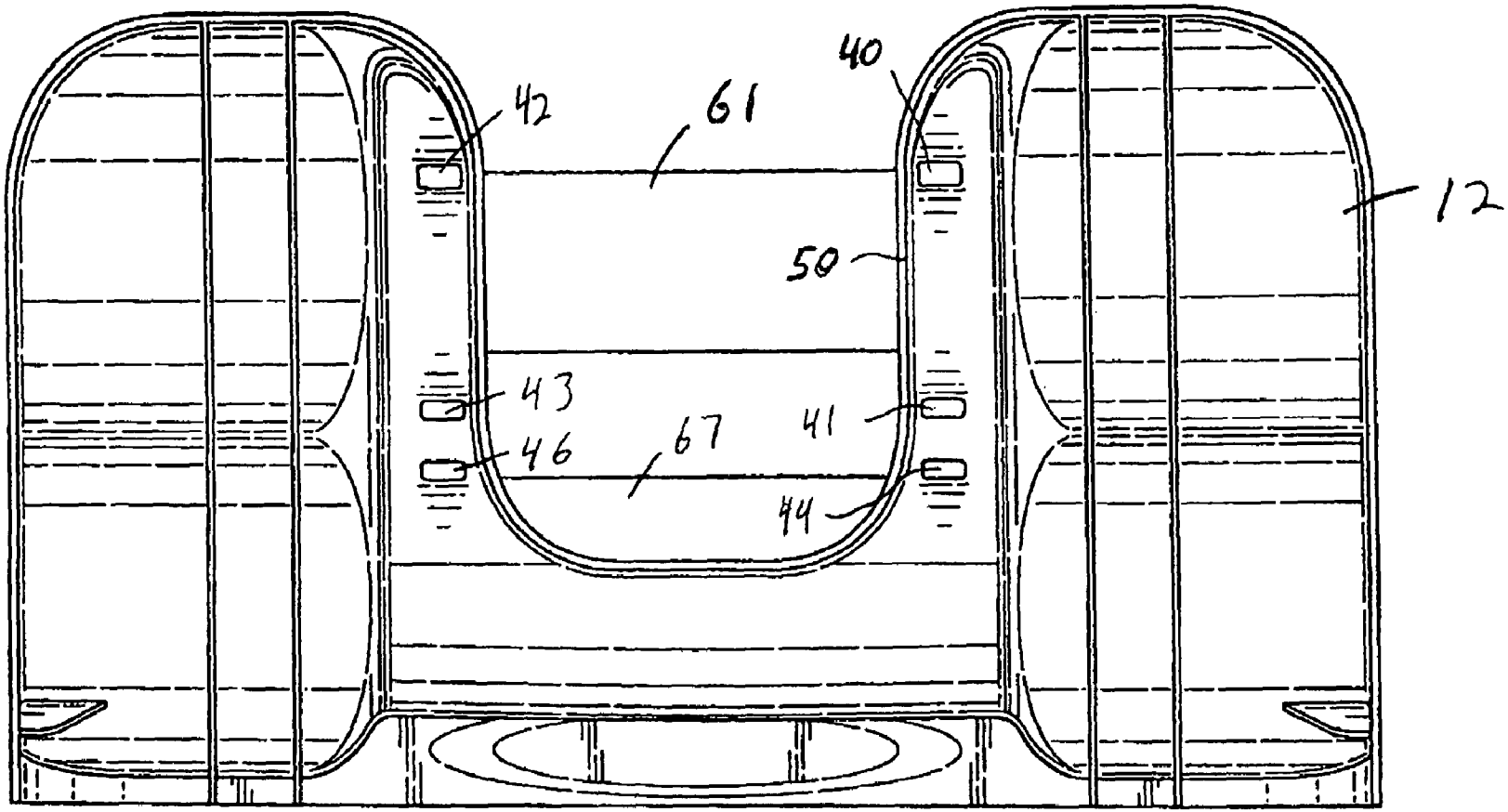

First section 9 may have a central "U" shaped cut-out or opening 50 that provides room for a user's hand to reach down and curl around narrow middle section 61 of dumbbell 60 so that it is easier to lift the dumbbell from section 9. As shown in FIG. 6, narrow middle portion 67 of second dumbbell 62 is also at least partially exposed to opening 50 for the same purpose.

Inner saddles 18 and 20 preferably have higher rear walls 32 and 33 that extend upward from bottom 12 of section 9 a distance that is about the same as or greater than the distance that the top of the enlarged ends of the dumbbells sit from bottom 12. This provides stability when dumbbell retail/storage rack 10 is stood on bottom 30 of section 8. Typically, retail/storage rack 10 is stood on bottom 30 on a shelf at retail locations, with product identifying information placed in area 34.

The two dumbbells can be held in place on the rack 10 when the rack is stood up on bottom 30, by passing retaining structures such as cable ties or twist ties through openings placed proximate the narrow middle portions of the dumbbells. The openings in the preferred embodiment can be seen in FIG. 1. Openings 40 and 41 can accept a cable tie 440 that holds one end of narrow middle portion 61 of dumbbell 60, and openings 42 and 43 can accept a cable tie that holds the other end. Similarly, pairs of openings 44 and 45 and 46 and 47 can accept cable ties that hold the narrow middle portion 67 of second dumbbell 62. The openings are located on opposite sides of the longitudinal centerline of the dumbbell so that a cable tie passed through the openings can be passed over the dumbbell and tightened so that the dumbbell is tightly held on the pack.

Once the purchaser brings home the inventive dumbbell retail/storage rack with the dumbbells held thereon by cable ties or the like, these can be cut or otherwise removed. The inventive pack is then typically stored on bottom side 12 as shown in FIG. 1, and vertically extending bottom 30 can be pushed up against a wall or the like if desired.

Figure 8:
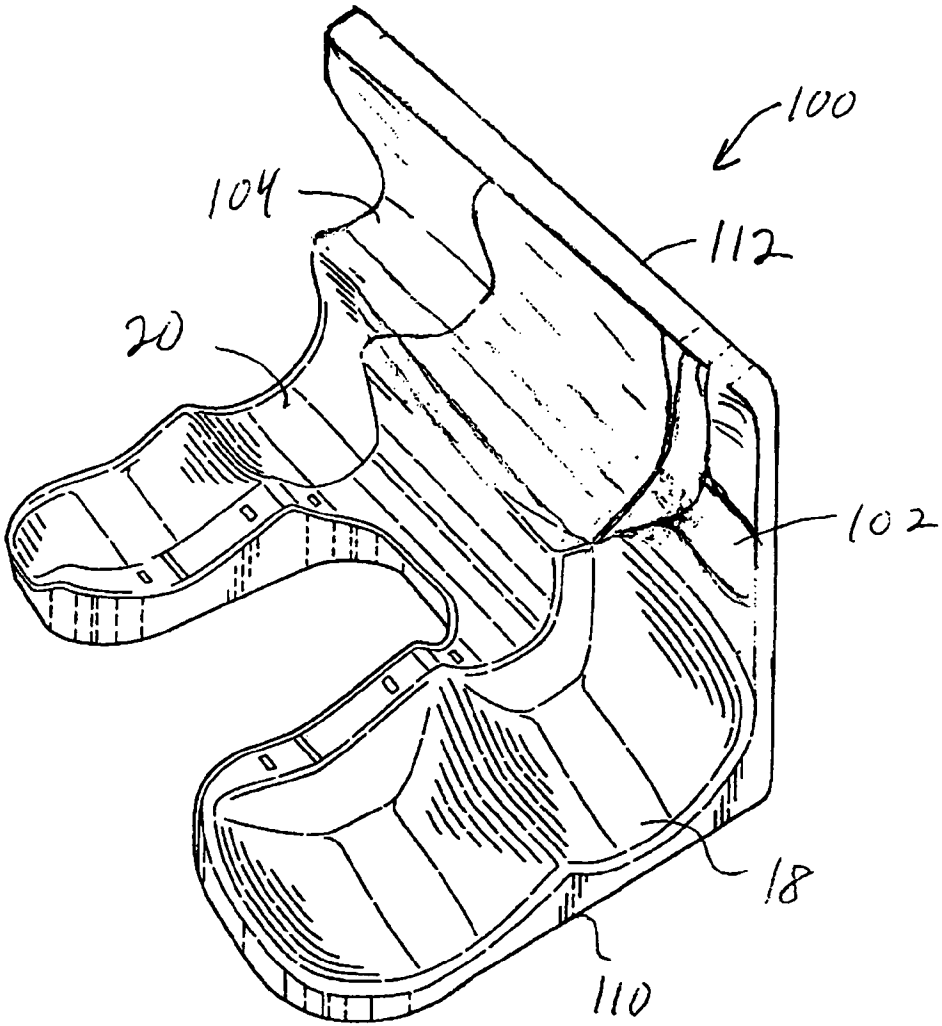
FIG. 8 is a perspective view similar to that of FIG. 1, but for an alternative preferred embodiment of the invention that is adapted to hold three dumbbells.

The inventive dumbbell retail/storage rack can be adapted to hold two or more dumbbells, and such two or more dumbbells can be held in configurations other than as shown in FIGS. 1-7. For example, as shown in FIG. 8, two or more dumbbells can be held vertically stacked one upon another in rack 100. In this case, a third dumbbell can be held in saddles 102 and 104 that maintain the dumbbell directly above or perhaps adjacent to the dumbbell sitting in saddles 18 and 20. In order for this embodiment to function better as a storage pack, ideally saddles 102 and 104 would be displaced slightly behind saddles 18 and 20 so that the upper dumbbell did not sit directly on top of the dumbbell below it, but rather was supported by saddles 102 and 104 such that three dumbbells could be stored with retail/storage rack 100 oriented on side 110 as shown in FIG. 8, or on side 112.

Figure 9:
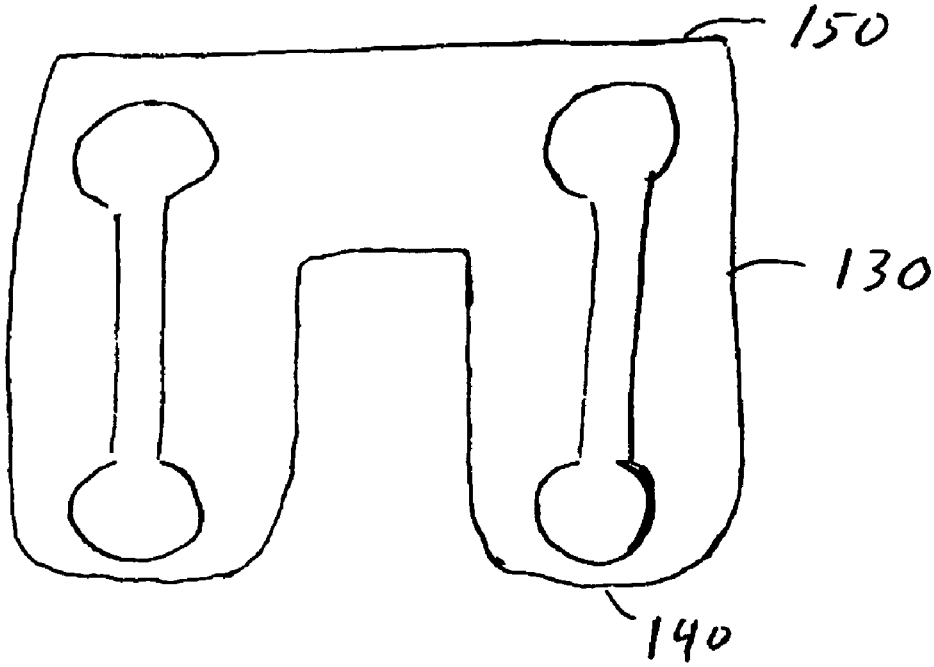
FIG. 9 is a simplified top view of an alternative arrangement that holds dumbbells in a back-to-front orientation.
Figure 10:
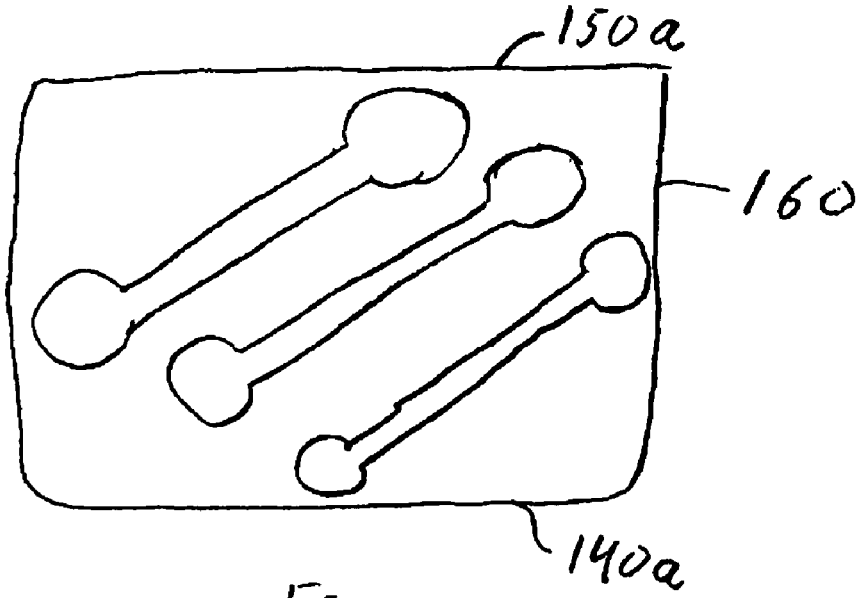
FIG. 10 is a similar view of another alternative in which the dumbbells are held in a cross-wise fashion.

Neither the orientation of, nor the quantity of, dumbbells in the rack are a limitation of the invention. For example, the orientation can be turned at 90 degrees as shown in FIG. 9, or at another angle as shown in FIG. 10. In FIG. 9, the dumbbells in rack 130 are aligned from front 140 to back 150, whereas in FIG. 10 in rack 160 they are both staggered and aligned at an angle from front 140*a* toward back 150*a*. By including saddles at appropriate locations, and by having two essentially perpendicular flat bottom surfaces that can support the rack in two orientations as described above, the inventive rack can successfully both display at retail and hold/organize in the home, a desired quantity of dumbbells of a desired size.

Although specific features of the invention are shown in some drawings and not others, this is for convenience only as the features may be combined in other manners in accordance with the invention.

Other embodiments will occur to those skilled in the art and are within the following claims.

What is claimed is:

1. A one-piece dumbbell retail and storage rack for displaying at retail and storing two or more dumbbells, each dumbbell having two enlarged ends and a more narrow middle portion, comprising:

a first section defining a first plane and comprising a bottom side adapted to sit on a flat surface;

a second section integral with the first section and having a top side and bottom side adapted to sit on a flat surface, the second section defining a second plane that is essentially perpendicular to the first plane;

where the first section further comprises a top side defining an essentially U-shaped opening, and first and second adjacent and parallel dumbbell-receiving structures, each dumbbell-receiving structure comprising two spaced saddles for receiving the enlarged ends of one dumbbell;

where each of the saddles comprises a pair of opposing upwardly-directed sloped sidewalls that are sloped away from the enlarged end of the dumbbell and an upwardly-directed interior wall adjacent to the U-shaped opening;

where the first dumbbell-receiving structure is adjacent to the second section, and the saddles of the first dumbbell-receiving structure are at least partially separated by the U-shaped opening;

where the saddles of the second dumbbell-receiving structure are separated by the U-shaped opening; and where at least one of the sidewalls in each saddle of the first dumbbell-receiving structure is coextensive with the top side of the second section.

2. The one-piece dumbbell retail and storage rack of claim 1, where the length of the bottom side of the second section is shorter than the length of the bottom side of the first section to form an essentially L-shaped rack.

3. The one-piece dumbbell retail and storage rack of claim 1, where at least one of the sidewalls in each saddle of the first dumbbell-receiving structure is coextensive with the adjacent sidewall in each of the saddles in the second dumbbell receiving structure.

4. The one-piece dumbbell retail and storage rack of claim 1, where the second section defines two dumbbell-receiving structures.

5. The one-piece dumbbell retail and storage rack of claim 4, where the length of the bottom side of the second section is longer than the length of the bottom side of the first section to form an essentially L-shaped rack.

6. The one-piece dumbbell retail and storage rack of claim 1, where at least one of the dumbbell-receiving structures defines a series of small openings that are adapted to accept dumbbell-retaining bands.

7. A one-piece dumbbell retail and storage rack for displaying at retail and storing two or more dumbbells, each dumbbell having two enlarged ends and a more narrow middle portion, comprising:

a first section defining a first plane and comprising a bottom side adapted to sit on a flat surface;

a second section integral with the first section and having a top side and bottom side adapted to sit on a flat surface, the second section defining a second plane that is essentially perpendicular to the first plane;

where the length of the bottom side of the second section is shorter than the length of the bottom side of the first section to form an essentially L-shaped rack;

where the first section further comprises a top side defining an essentially U-shaped opening, and first and second adjacent and parallel dumbbell-receiving structures, each dumbbell-receiving structure comprising two spaced saddles for receiving the enlarged ends of one dumbbell, where each of the saddles comprises a pair of opposing upwardly-directed sloped sidewalls that are sloped away from the enlarged end of the dumbbell and an upwardly-directed interior wall adjacent to the U-shaped opening, and where at least one of the sidewalls in each of the saddles in the first dumbbell receiving structure is coextensive with the adjacent sidewall in each of saddles in the second dumbbell-receiving structure, and the opposing sidewall in each of the saddles in the first dumbbell-receiving structure is coextensive with the top side of the second section;

where the saddles of the first dumbbell-receiving structure are at least partially separated by the U-shaped opening; and where the saddles of the second dumbbell-receiving structure are separated by the U-shaped opening.

8. The one-piece dumbbell retail and storage rack of claim 7, where the second section defines two dumbbell-receiving structures and the length of the bottom side of the second section is longer than the length of the bottom side of the first section to form an essentially L-shaped rack.

* * * * *